US006115990A

United States Patent [19]

Vogelsanger

[11] Patent Number: 6,115,990

[45] Date of Patent: Sep. 12, 2000

[54] METHOD OF FILLING PHARMACEUTICAL MULTICHAMBER PACKAGES

[75] Inventor: Matthias Vogelsanger, Zurich, Switzerland

[73] Assignee: Fleximation AG, Zurich, Switzerland

[21] Appl. No.: 09/061,184

[22] Filed: Apr. 17, 1998

Related U.S. Application Data

[63] Continuation of application No. PCT/CH95/00247, Oct. 23, 1995.

[51] Int. Cl.[7] ..... B65B 5/10; B65B 5/12

[52] U.S. Cl. ..... 53/53; 53/246; 53/251; 53/475

[58] Field of Search ..... 53/53, 495, 493, 53/246, 52, 475, 473, 237, 244, 255, 251, 250, 249

[56] References Cited

U.S. PATENT DOCUMENTS

| | | | |
|---|---|---|---|
| 3,080,033 | 3/1963 | Scott et al. | 53/246 X |
| 3,530,639 | 9/1970 | Bross | 53/246 X |
| 3,889,447 | 6/1975 | Garris | 53/53 |
| 4,472,922 | 9/1984 | Romagnoli | 53/53 |
| 4,655,026 | 4/1987 | Wigoda | 53/55 |
| 4,881,356 | 11/1989 | Beezer et al. | 53/53 |
| 5,799,468 | 9/1998 | Eck et al. | 53/246 X |

FOREIGN PATENT DOCUMENTS

| | | |
|---|---|---|
| 35 13 507 A1 | 11/1985 | Germany . |
| 37 04 423 A1 | 8/1988 | Germany . |
| 37 09 015 A1 | 10/1988 | Germany . |
| 42 08 818 A1 | 9/1993 | Germany . |
| 2 155 892 | 10/1985 | United Kingdom . |

OTHER PUBLICATIONS

Derwent WPI Acc No: 85–290632/198547, English language abstract of Germany 35 13 507.

Derwent WPI Acc No: 88–243092/198835, English language abstract of Germany 37 04 423.

Derwent WPI Acc No: 88–300389/198843, English language abstract of Germany 37 09 015.

Derwent WPI Acc No: 93–304231/199339, English language abstract of Germany 42 08 818.

*Primary Examiner*—James F. Coan

*Attorney, Agent, or Firm*—Pennie & Edmonds LLP

[57] ABSTRACT

A method for the automated filling of pharmaceutical multichamber packages for clinical studies. The multichamber packages include a plurality of individual chambers, e.g. in the form of blisters, arranged in one plane. The products to be packed are fed from a storage container by a conveyor device into a mobile duct; the free end of the feed duct is guided to the desired chamber by a robot arm capable of swinging parallel to the plane of the individual chambers, and the product is introduced into the chamber. The individual steps are controlled by a computer. The robot arm has one or more freely programmable axes of movement, allowing the products to be conveyed to and introduced into the predetermined chambers in the plane in accordance with a freely selectable program which can be stored in the computer.

14 Claims, 2 Drawing Sheets

METHOD OF FILLING PHARMACEUTICAL MULTICHAMBER PACKAGES

This is a continuation of application Ser. No. PCT/CH95/00247 filed Oct. 23, 1995, the contents of which are expressly incorporated herein by reference.

BACKGROUND OF THE INVENTION

The invention is directed to a method and device for the automatic filling of pharmaceutical multichamber packages for clinical studies.

From prior art there are already similar methods known, whereby the choice of the products to be packaged is programmed in advance so that these methods are not suitable for small series or special manufactures as are required in the case of clinical studies.

The main disadvantage of these known methods is that each alteration of the filling program is connected with extensive and time consuming adaptation work. The automatic flexible filling of blisters or comparable primary packages for small runs of pharmaceuticals or other products is therefore not resolved.

SUMMARY OF THE INVENTION

The invention relates to a method for the automatic filling of pharmaceutical multichamber packages for clinical studies which is freely programmable and therewith very flexible and adaptable to the respective necessities.

This method is specifically directed to the automatic filling of pharmaceutical multichamber packages for clinical studies where the multichamber packages have a plurality of individual chambers arranged in one plane. The method comprise the steps of conveying the products to be packaged from a storage container into a mobile feed duct having a free end; guiding the free end of the feed duct to an individual chamber of the package with a robot arm capable of moving parallel to the plane of the individual chambers; introducing the product to be packaged into the individual chamber with the control of the preceding steps being executed by a computer, with the robot arm having one or more free programmable axes of movement so that the products to be packaged may be conveyed and introduced in the plane to the predetermined individual chamber by a freely selectable program stored in the computer; and comparing the received filling with the programmed standard by an electronic image processing unit.

A device which is useful for carrying out this method comprises a storage container for holding products to be packaged, a conveyer device for conveying products to be packaged, a mobile feed duct having a free end for directing conveyed products, a robot arm which is movable in one or more freely programmable axes of movement and which is operatively associated with the free end of the feed duct, and a computer for controlling the conveyer device and the robot arm to fill the chambers of the multichamber packages with the products.

The feeding of the products to be packaged takes place from a container, preferably by means of vibration technique or by gravitation effects via a mobile feed duct such as for example a flexible spring tube to a robot arm. The robot arm brings the feed duct to the desired position in the package whereafter the product is purposefully inserted. The products may be accumulated in the mobile feed duct and be mechanically separated before the insertion if the product to be packaged necessitates this.

As several products can be fed via several feed ducts to the device according to the invention so—thanks to the free programmability—the advantage of producing multichamber packages with different contents without adaptation work is achieved.

The method according to the invention basically allows to carry out the programming of the automatic filling process in different manners which are described in the following:

A) Numerical input

In case of this method the coordinates of the points of insert are numerically entered and stored in the desired sequence as absolute values of relative to the package so that the computer control system may subsequently run the process independently.

B) Teach-in

In case of this method the points of insert are driven to with the robot arm from the operator in the desired sequence by means of a joystick, keys or another suitable device so that the computer control system may subsequently run the process independently. This process is called "Teach-in" in connection with industrial robots.

C) Display and pointer

In case of this method the points of insert of a package are represented on a display. The operator allocates the desired product to the intended point of insert (e.g. blister court) by means of a pointing device (e.g. mouse). A computer program ensures that the filling unities receive the respective driving commands so that the computer control system may subsequently run the process independently. To the recording of the points of insert a camera with a image processing unit may be applied or the layout of the packaging may be adapted from a CAD program.

A preferred embodiment of the invention consists therein that after the carrying out of the filling of the individual chambers a comparison between the reached filling and the programmed standard is effected by means of an electronic image processing unit so that in case of a deviation the respective faulty multichamber package may be eliminated.

BRIEF DESCRIPTION OF THE DRAWINGS

The invention and further embodiments of the invention are described in more detail in the following section by means of the partially schematic representations of preferred embodiments, wherein.

DETAILED DESCRIPTION OF THE PREFERRED EMBODIMENTS

Figure 1:
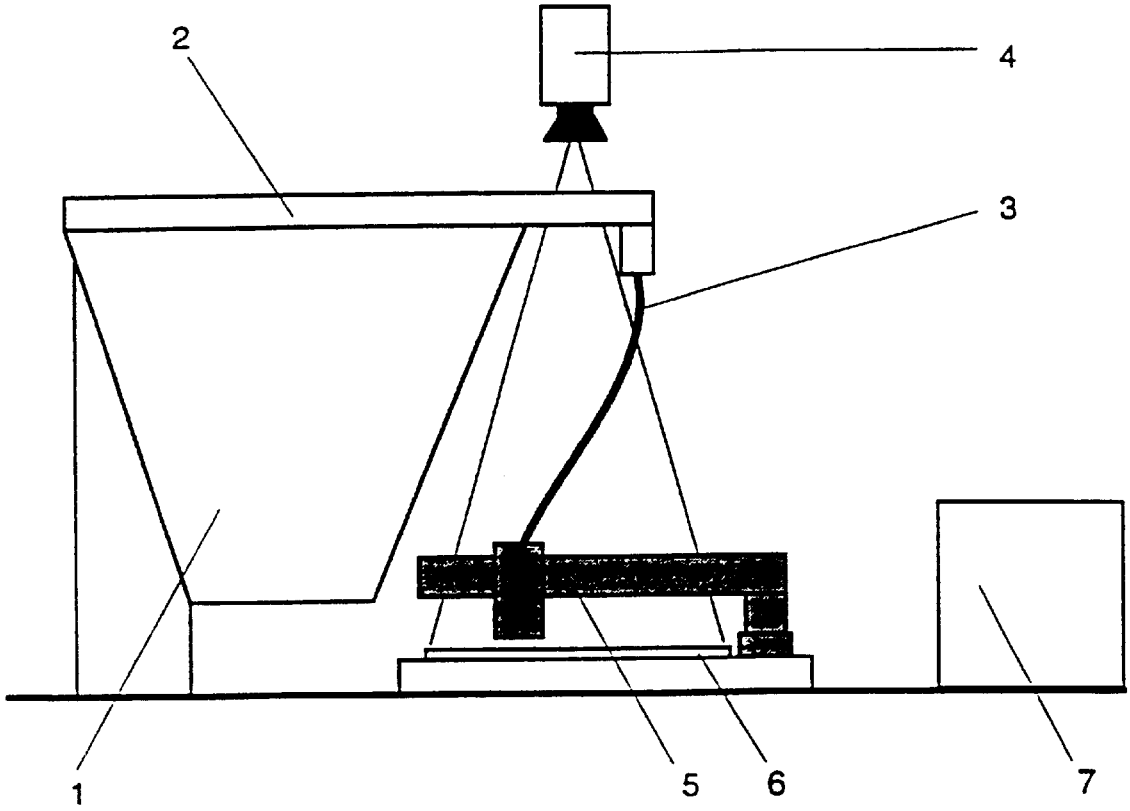
FIG. 1 is a schematic representation of a device according to the invention for an individual product.

The device according to the invention shown in FIG. 1 includes a storage container 1 for the product to be packaged, a conveyer device 2 for the product to be packaged in the form of a vibration device, a mobile feed duct 3 for the product to be packaged in the form of a flexible helical tube as well as a robot arm 5 which is acting upon the free end of the feed duct and is moveable in two free programmable axes of movement standing orthogonal to each other. The robot arm 5 is controlled by a computer 7. The robot arm 5 may provide only one or more than two freely programmable axes of movement. However, preferably the 2 axes-configuration with cartesian X-Y kinematic is applied which allows to insert the products in the intended blister courts of the multichamber package 6 in the plane freely choosable corresponding to a production program. In this case the axes of movement may be driven e.g. via a servomotor whereby the motion of rotation is converted into a linear motion by means of a helical spindle.

For the insertion of the products e.g. a third vertical arranged axis or a pneumatically driven lifting element may be applied if the product to be packaged requires this.

The different axes of the robot arm 5 may be controlled individually or coordinately by means of a continuous path control obtainable on the market. The control device also takes over the storage of the production program.

Figure 2:
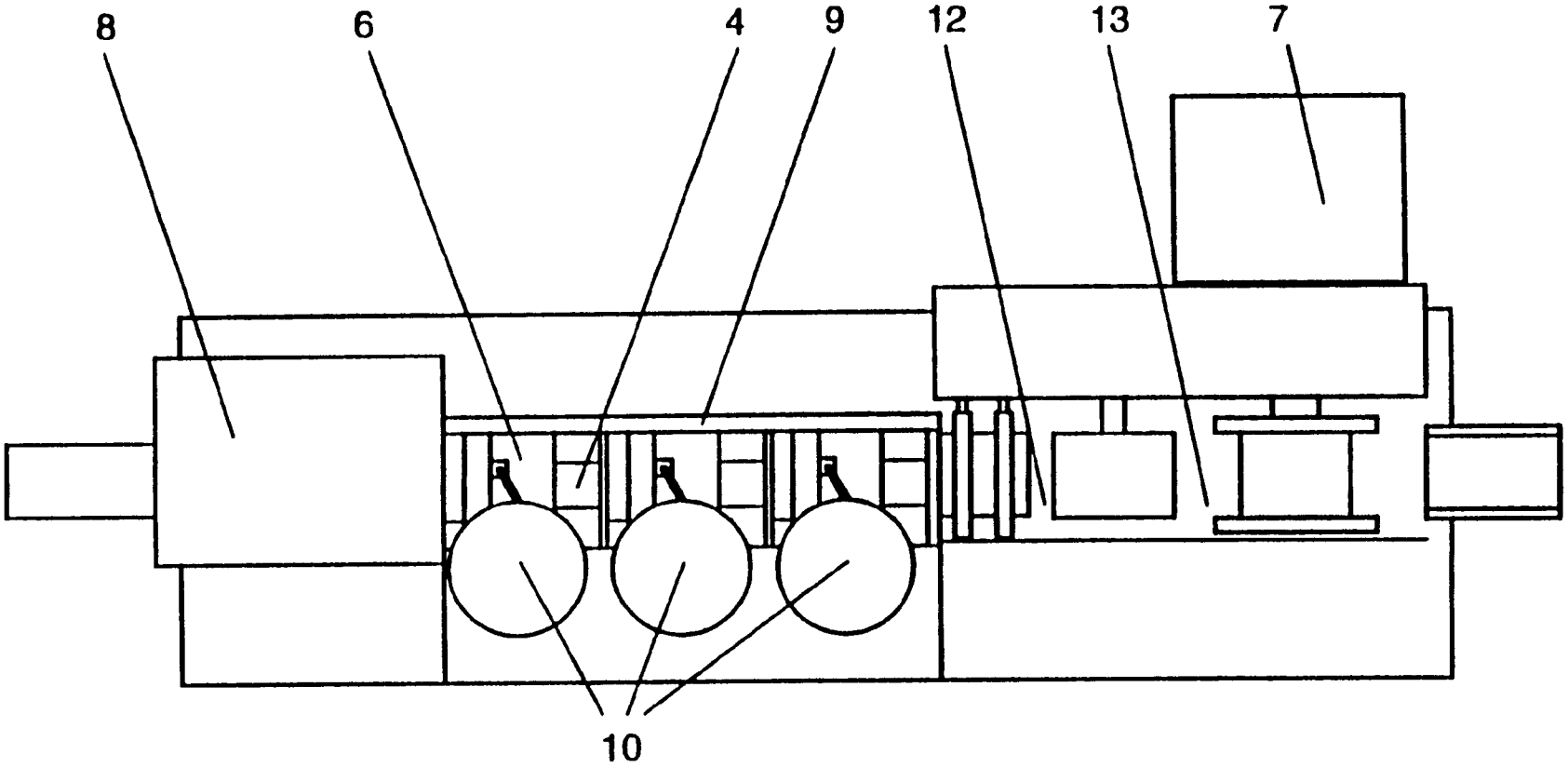
FIG. 2 is a schematic representation of a device according to the invention for three different products.

As shown in FIG. 2 also several filling units 10 (with container 1, conveyer device 2, feed duct 3 and robot arm 5 according to FIG. 1) may be combined with each other to insert different products in a sole multichamber package 6.

If there are several filling units combined the multichamber package 6 may be transported between the filling units 10 by cycles or continuously. In the first case the multichamber package 6 stands still during the action of insertion. In the second case the control system of the computer may consider the motion of the multichamber package 6 or the robot arm 5 (FIG. 1) may perform the motion of transport via mechanical connection.

The example shown in FIG. 2 represents a device according to the invention having three filling units 10 to automatically and flexibly package test samples with different occupancy of products.

On a cycled or continuously working form station 8 the multichamber packages 6 are formed of coil material into the form of blisters and transported to the filling section 9 where in each case a filling unit 10 inserts one sort of product corresponding to the production program stored in the computer 7.

A camera 4 (FIG. 1) arranged after each filling unit 10 above the multichamber package 6 with an electronic image processing system verifies after succeeded automatic filling whether the filling process has been executed according to the programmed standard. The filled multichamber packages 6 are farther transported on the filling section, provided with a lidding foil at the station 12 and cut at the station 13. One or several computers 7 control the form station 8, the filling units 10, the stations 12 and 13 as well as the cameras 4 with the image processing system.

What is claimed is:

1. A method for the automatic filling of pharmaceutical multichamber packages for clinical studies, the multichamber packages having a plurality of individual chambers arranged in one plane, which method comprises:

conveying the products to be packaged from a storage container into a mobile feed duct having a free end;

guiding the free end of the feed duct to an individual chamber of the package with a robot arm capable of moving parallel to the plane of the individual chambers;

introducing the product to be packaged into the individual chamber with the control of the preceding steps being executed by a computer, with the robot arm having one or more free programmable axes of movement so that the products to be packaged may be conveyed and introduced in the plane to the predetermined individual chamber by a freely selectable program stored in the computer; and comparing the received filling with the programmed standard by an electronic image processing unit.

2. The method according to claim 1, which further comprises eliminating faulty multiple chamber packages that are detected as deviations by the comparison of the received filling and the programmed standard.

3. The method according to claim 1, which further comprises numerically entering and storing coordinates of the points where the products to be packaged are to be introduced into the individual chambers in a desired sequence in the computer as absolute values or relatively to the position of the multichamber package so that the filling may be effected subsequently automatically by the program stored in the computer.

4. The method according to claim 3, which further comprises driving the points where the products are to be packaged to the desired sequence via the robot arm using the corresponding coordinates stored in the computer so that the filling may be effected subsequently automatically by the program stored in the computer.

5. The method according to claim 3, which further comprises choosing the points where the products are to be packaged by a pointing device on a display that shows the multichamber package with its individual chambers so that filling may be effected subsequently automatically by means of the program stored in the computer.

6. A device for the automatic filling of pharmaceutical multichamber packages having a plurality of individual chambers comprising a storage container for holding products to be packaged, a conveyer device for conveying products to be packaged, a mobile feed duct having a free end for directing conveyed products, a robot arm which is movable in one or more freely programmable axes of movement and which is operatively associated with the free end of the feed duct, and a computer for controlling the conveyer device and the robot arm to fill the chambers of the multichamber packages with the products.

7. The device according to claim 6, which further comprises a camera associated with an electronic image processing unit for monitoring the filling of the packages, wherein the camera and image processing unit are controlled by the computer.

8. The device according to claim 6, wherein the axes of movement of the robot arm are realized as 1-axis-configuration with the cartesian X-coordinates.

9. The device according to claim 6, wherein the axes of movement of the robot arm are realized as 2-axes-configuration with cartesian X-Y-coordinates.

10. The device according to claim 6, wherein the axes of movement of the robot arm are realized as 3-axes-configuration with cartesian X-Y-Z-coordinates.

11. The device according to claim 6, wherein the individual axes of movement of the robot arm are controlled by a servomotor with the motion of rotation of the servomotor being converted into linear motion by a helical spindle.

12. The device according to claim 6, wherein the conveyer device comprises a vibrator feeding device.

13. The device according to claim 6, wherein the feed duct is a flexible spring tube.

14. The device according to claim 6, wherein the multichamber package is a blister pack and the individual chambers are blister courts.

* * * * *